United States Patent [19]

Hannemann

[11] 4,102,280

[45] Jul. 25, 1978

[54] FEED DEVICE FOR FLEXIBLE WORKPIECES, ESPECIALLY FOR A SEWING MACHINE

[75] Inventor: Franz Hannemann, Detmold, Germany

[73] Assignee: Durkoppwerke GmbH, Bielefeld, Germany

[21] Appl. No.: 769,202

[22] Filed: Feb. 16, 1977

[30] Foreign Application Priority Data

Feb. 23, 1976 [DE] Fed. Rep. of Germany ..... 2607235

[51] Int. Cl.[2] ..... D05B 21/00

[52] U.S. Cl. ..... 112/121.26; 112/203

[58] Field of Search ..... 112/121.12, 121.11, 112/121.26, 121.27, 207, 203

[56] References Cited

U.S. PATENT DOCUMENTS 3,713,408 1/1973 Deeks et al. ..... 112/121.26 X 3,903,818 9/1975 Marforio ..... 112/121.26

4,030,430 6/1977 Pickert et al. ..... 112/121.26

*Primary Examiner*—H. Hampton Hunter

*Attorney, Agent, or Firm*—Karl F. Ross

[57] ABSTRACT

A feed device for flexible workpieces comprises a clamp for securing two workpieces together. The clamp is movable along a guide in line with the displacement of the workpieces past a sewing station by the sewing machine feed. A retarding force is continuously applied to the clamp to maintain a tension on the workpieces as they are drawn through the sewing station preferably by a turbine driven by compressed air. The retarding force is a continuously applied restoring force which can be switched between a relatively substantial force designed to return the clamp to its starting position and a tension force which can be reduced to substantially a zero value.

3 Claims, 3 Drawing Figures

N
A
DR
III
III
1
2
3
4
5
6
7
10
11
12
13
14
14a
15
16
100
101
100'
101'
5a
10a
10b

FEED DEVICE FOR FLEXIBLE WORKPIECES, ESPECIALLY FOR A SEWING MACHINE

FIELD OF THE INVENTION

The present invention relates to a feed device for flexible workpieces and, more particularly, to a device for maintaining a retarding force upon workpieces adapted to be fed to a sewing station.

BACKGROUND OF THE INVENTION

In German Utility Model (Gebrauchsmusterschrift) No. 7 438 034, there is described a device which can be used in conjunction with a sewing machine and in which a pair of flexible workpieces, e.g. fabric pieces to be stitched together, can be clamped, the device applying a retarding force to the clamp to resist the displacement of the workpieces past the sewing station by the sewing machine feed.

The device comprises a pair of alternately effective clamps adapted to engage the workpieces and connected to a weight which provides the retarding force, i.e. a restoring force resisting the displacement of the clamp which is in engagement with the workpieces toward the sewing station. A cable is connected between the downwardly hanging weight and the clamp so that the weight is raised as the clamp is horizontally displaced toward the sewing station. Upon release of the clamp from the workpieces, the weight again falls to enable return of the clamp to its starting position so that a new pair of workpieces can be mounted in the clamp and the operation repeated.

The weight is intended to provide a light braking force to the advance of the workpieces so that the latter will maintain a linear feed into the sewing machine and a uniform sewing seam can be produced. The device thus performs the function of the sewing machine operator when he retards the advance of the fabric pieces through the sewing station.

The clamp retains the two pieces so that their edges to be stitched together coincide and the weight maintains a slight stretching effect to insure continuous and uniform stitch formation. The traction force is relatively small, e.g. of the order of 50 grams.

It has been found, however, that even such a minimum traction or tension force is too great for certain workpieces, e.g. very thin materials, so that excessive stretching develops which results in detrimental folds in the stitched seam.

In many cases it is desirable to reduce this retarding force to close to zero, a difficult enterprise with conventional systems of the type described, even where the weights are interchangeable. One of the reasons for this problem is that it is desirable to displace the system into its starting position and the restoring force necessary for this purpose is far in excess of the close-to-zero value which may be desired for fabric feed.

In other words, a restoring force which tends to permit the clamp to be advanced toward the stitching location with sufficiently low tension on the workpiece is frequently insufficient to overcome the friction and the inertia of the clamp in displacing it back into its starting position. Naturally, when it is desired to displace the clamp back into its starting position at high speed so that the operation can be repeated, immediately following the conclusion of a previous stitching operation, as is necessary for modern sewing machine production rates, the restoring force is inadequate. The conventional system described has thus been incapable of solving the problem, especially when it is desirable tc operate with a single fabric clamp.

OBJECTS OF THE INVENTION

It is the principal object of the present invention to provide a device of the type described, especially for controlling the feed of a workpiece or a pair of workpieces to a sewing location, whereby the aforedescribed disadvantages are obviated.

It is another object of the invention to provide a device for controlling the feed of workpieces to a sewing location which permits a retarding force to be applied to the workpiece which is adjustable within wide limits and nevertheless is capable of returning the clamp to its starting position at relatively high rates.

Still another object of the invention is to provide a device for controlling the feed of workpieces to a stitching station which can provide an adjustable practically zero retarding force to the workpieces.

SUMMARY OF THE INVENTION

These objects and others which will become apparent hereinafter are attained, in accordance with the present invention, in a device for controlling the feed of flexible workpieces, e.g. precut pieces of textile fabric to be stitched together along juxtaposed edges, which comprises a clamping device for the workpieces displaceable in a guide from a starting location remote from the stitching station and toward the latter against a retarding force. According to the invention, the retarding force applied to the clamp is continuously effective and can be reduced to a value approximating zero.

According to an important feature of the invention, the retarding force is generated by a turbine connected to a cable assembly to which the clamp is affixed, the turbine being driven by compressed air. According to this aspect of the invention, a nozzle is trained upon the turbine and tends to drive it continuously in a sense applying the retarding force to the clamp, the retarding force being overcome by the fabric-feed device of the sewing machine. According to the invention, the nozzle is connected alternately, via a two-position valve, either directly to a source of compressed air or through a throttle, the throttle being adjustable for limiting the retarding force during advance of the fabric, the bypass line across the throttle serving to conduct air to the nozzle to propel the turbine so as to generate the maximum restoring force for return of the clamp into its starting position.

Still another feature of the invention resides in providing switch means operable by the clamp when the latter reaches its position proximal to the sewing station for operating the valve. The switch means can be a magnetically operated switch while the valve is an electromagnetic valve connected in circuit with the switch means.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figures 1, 2, 3:
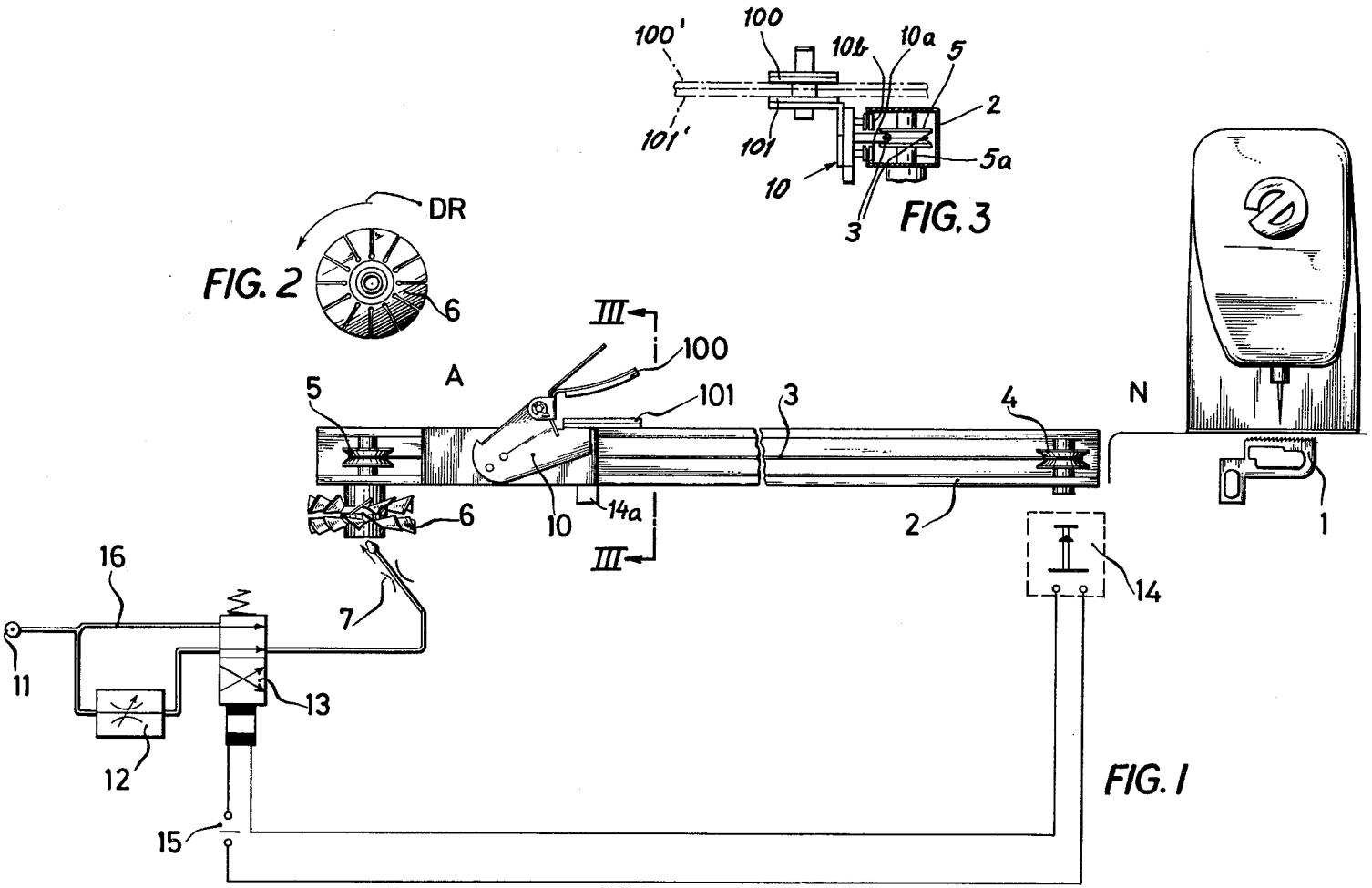
FIG. 1 is a side-elevational view of a feed-control device according to the invention shown diagrammatically.
FIG. 2 is a bottom plan view of a turbine according to the present invention.
FIG. 3 is a somewhat diagrammatic cross-setional view taken along the line III — III of FIG. 1.

In the drawing I have shown a clamp 10 of the type described and illustrated in German Utility Model (Gebrauchsmuster) No. 7,438,034 and provided with clamping jaws 100 and 101 adapted to engage fabric pieces 100' and 101' between them. The clamp 10 is displaceable on rollers 10*a* and 10*b* along a rail 2 of U profile between a starting location A, in which the fabric pieces are inserted into the clamp, and a stitching station N. A sewing machine is located at the stitching station and is provided with the diagrammatically illustrated fabric feed device represented at 1.

When the fabric pieces are inserted into the clamp 10 and the latter is closed thereon either automatically or by hand, the fabric workpieces are advanced past the stitching location N by the feed 1, thereby entraining the clamp 10 to the right. In the right-hand extreme position of the clamp, the latter opens to release the workpieces and is returned to the left to receive a new pair of workpieces to repeat the operation.

The clamp 10 is connected with an endless cable 3 passing around pulleys 4 and 5 journaled at the extreme ends of the rail 2 on, for example, shafts 5*a*. The shafts 5*a* are connected to a turbine 6 of conventional construction. A nozzle 7 is trained on the turbine 6 and is powered by compressed air from a source 11, e.g. the compressed-air line normally provided at each sewing machine station in the plant. The turbine can be driven in the counterclockwise sense (direction DR as seen in FIG. 2), the turbine having oppositely oriented upper and lower blades which deflect the compressed air through substantially a right angle. As a result, the turbine tends to apply a tension force to the left on cable 3 biasing the clamp 10 in this direction. The force thus retards the displacement of the clamp 10 to the right. Upon release of the clamp 10 from the workpieces, the restoring force generated by the turbine 6 can entrain the clamp to the left when the turbine is driven through the bypass line 16. An adjustable throttle 12 is provided in parallel with the bypass line 16 to feed the nozzle 7 at a reduced rate which can be controlled to approximate a zero retarding force if desired. The throttle 12 and the bypass line 16 are connected to two ports of a four-port, two-position valve 13 which, in the position illustrated, connects the throttle 12 with the nozzle 7. In the other extreme position the valve 13 connects the bypass line 16 to the nozzle 7.

The valve 13 is of the electromagnetic type and is connected in series with a direct-current source 15, e.g. a battery or a rectifier connected to the power lines associated with a sewing machine plant, and a reed switch 14 which can be operated by a magnet 14*a* carried by the clamp. A spring, shown schematically, holds the valve in the position illustrated so that, only upon attaining the extreme right-hand position, is the switch 14 operated to shift the valve 13 into the position in which the turbine 6 propels the clamp 10 at high speed to the left, i.e. into its starting position. The switch 14 is of the normally open type which can be briefly closed by the magnet 14*a* when the clamp 10 moves into its extreme right-hand position. The coil of the electromagnetic valve 13 can be of the time-delay type so that the bypass 16 is connected to the nozzle 7 for a period sufficient to drive the clamp 10 fully into its starting position, at full speed. Once the clamp 10 is in its extreme left-hand position, the valve 13 again switches over to permit the operating cycle to repeat.

While the turbine arrangement is preferred, it is also possible to utilize an electric control motor of the direct-current type capable of permitting slip of the rotor or armature during the advance of the clamp 10 to the right. However, the use of a fluid pressure medium has been found to be particularly advantageous not only because of its cost but because of the availability of compressed air in most sewing plants of the type in which the device is intended to be used. When an electric motor is employed, naturally, the latter can be connected in series with a potentiometer and a shunt across the potentiometer which can be alternately connected to the motor, the potentiometer being adjustable to reduce the retarding force substantially to a zero value in the case when minimum retarding force is to be employed.

I claim:

1. A feed-control device for flexible workpieces, comprising:

a rail defining a transport path for fabric workpieces to be advanced;

a clamp engageable with said workpieces and displaceable from a starting location to another location;

feed means engageable with said workpieces for advancing said workpieces to draw said clamp from said starting location to said other location; and retarding means connected with said clamp for applying an adjustable retarding force thereto resisting the displacement of said workpieces from said starting location to said other location with a variable retardation capable of reduction to substantially zero, said retarding means including a cable displaceable along said rail and connected to said clamp, said device including a turbine operatively connected to said cable, a nozzle trained on said turbine, said nozzle being connected to a source of compressed air, a throttle connected to said source and a bypass line connected in parallel to said throttle, and means for selectively connecting said throttle and said bypass line to said nozzle.

2. The device defined in claim 1 wherein the means for selectively connecting said throttle and said bypass line to said nozzle includes an electromagnetic valve, a limit switch in circuit with said valve and means on said clamp for operating said limit switch to switch said valve to connect said bypass line to said nozzle when said clamp reaches said other location.

3. The device defined in claim 1, further comprising a sewing machine at said other location provided with said feed means engageable with said workpiece for displacing said clamp from said starting location to said other location.

* * * * *